US010185263B2

(12) United States Patent
Hayashi et al.

(10) Patent No.: US 10,185,263 B2
(45) Date of Patent: Jan. 22, 2019

(54) IMAGE FORMING APPARATUS HAVING A FIXING PORTION AND AT LEAST ONE OPENING FOR FLUID COMMUNICATION BETWEEN AN INSIDE AND AN OUTSIDE OF THE FIXING PORTION

(71) Applicant: CANON KABUSHIKI KAISHA, Tokyo (JP)

(72) Inventors: Naoki Hayashi, Yokohama (JP); Keisuke Fujita, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/438,020

(22) Filed: Feb. 21, 2017

(65) Prior Publication Data

US 2017/0242380 A1 Aug. 24, 2017

(30) Foreign Application Priority Data

Feb. 22, 2016 (JP) ..... 2016-030800

(51) Int. Cl.
*G03G 15/20* (2006.01)
*G03G 21/20* (2006.01)

(52) U.S. Cl.
CPC ..... *G03G 15/2096* (2013.01); *G03G 15/2017* (2013.01); *G03G 15/2053* (2013.01); *G03G 21/206* (2013.01)

(58) Field of Classification Search
CPC ..... G03G 2221/1645; G03G 21/20; G03G 21/203; G03G 21/206; G03G 15/2096
USPC ..... 399/92, 91
See application file for complete search history.

(56) References Cited

U.S. PATENT DOCUMENTS

2007/0059019 A1* 3/2007 Kasama ..... G03G 15/6573 399/91

FOREIGN PATENT DOCUMENTS

| | | | |
|---|---|---|---|
| JP | 2004-90221 A | | 3/2004 |
| JP | 2006-276215 A | | 10/2006 |
| JP | 2007-219430 A | | 8/2007 |
| JP | 2010-266638 A | | 11/2010 |
| JP | 2013097054 A | * | 5/2013 |
| JP | 2015-200814 A | | 11/2015 |

* cited by examiner

*Primary Examiner* — Susan S Lee
(74) *Attorney, Agent, or Firm* — Venable LLP

(57) ABSTRACT

An image forming apparatus includes a photosensitive drum, an image forming portion for forming an image on the drum and for transferring the image to a sheet, and a fixing portion for fixing the image on the sheet, while heating the sheet in a fixing nip. The fixing portion is provided above the drum, and includes a first roller, a second roller cooperative with the first roller to form the fixing nip, first and second covers for protecting the first and second rollers, respectively, and at least one opening for fluid communication between an inside and an outside of the fixing portion, the opening being provided in the first cover at a position that is lower than a line connecting a rotation axis of the first roller and a rotation axis of the second roller, as seen along a rotational axis of the second roller.

22 Claims, 12 Drawing Sheets

IMAGE FORMING APPARATUS HAVING A FIXING PORTION AND AT LEAST ONE OPENING FOR FLUID COMMUNICATION BETWEEN AN INSIDE AND AN OUTSIDE OF THE FIXING PORTION

FIELD OF THE INVENTION AND RELATED ART

The present invention relates to an image forming apparatus such as a color copying machine, a color printer, and the like, which uses an electrophotographic method.

FIG. 11 shows a laser printer 1300 which uses an electrophotographic recording method. The sheets P of recording medium in a tray 3 are conveyed one by one out of the tray 3, and into the main assembly of the printer 1300 by a combination of a roller 4 and a pad 10. Then, each sheet P of recording medium is corrected in attitude by a pair of registration rollers 5.

A photosensitive drum 201 rotates in the direction indicated by an arrow mark a. As it rotates, it is charged by a charge roller 202. Then, the charged portion of the peripheral surface of the photosensitive drum 201 is scanned by the beam of laser light modulated in accordance with the information of the image to be formed. Thus, an electrostatic latent image is formed on the peripheral surface of the photosensitive drum 201. This electrostatic latent image is developed into a toner image by a development roller 6. Then, the toner image is transferred onto the sheet P of recording medium, in a transfer nip T which a combination of the photosensitive drum 201 and a transfer roller 6 forms. A referential code 204 stands for a cleaner which cleans the photosensitive drum 201. After the transfer of the toner image onto the sheet P, the sheet P is conveyed along a guide 7 to the fixing portion 100, which has: a cylindrical fixation film 103; a heater 105 which is in contact with the inward surface of the fixation film 103; and a pressure roller 102 which forms a fixation nip N with the heater 105 by being pressed against the heater 105 with the presence of the fixation film 103 between itself and the heater 105. The toner image on the sheet P is fixed to the sheet P by being heated and pressed in the nip N. After the fixation of the toner image to the sheet P, the sheet P is conveyed further along a guide 13, and then, is discharged onto a tray 8 by way of a pair of discharge rollers 104.

In the image forming apparatus 1300 structured as described above, as a sheet P of recording medium is heated by the heater 105, water vapor is generated from the sheet P. This water vapor has to be prevented from condensing on the adjacencies of the path of the sheet P. Thus, an image forming apparatus, as disclosed in Japanese Laid-open Patent Application No. 2004-90221 is provided with such a sheet conveyance guide (13), which is for guiding a sheet P of recording medium as the sheet P is sent out of the fixation nip N, and is provided with an opening 14 as a passage for releasing the water vapor upward, as shown in the comparative image forming apparatus 1300 shown in FIG. 11.

However, if the image forming apparatus 1300 is used in the adjacencies of an air blowing apparatus 12 such an air conditioner, a room fan, etc., it sometimes occurs that air is blown toward the fixation nip N from the air blowing apparatus 12. As air is blown toward the fixation nip N, it is possible that the body of air, which contains the water vapor from the sheet P of recording medium will flow backward, that is, upstream of the fixation nip N in terms of the direction in which the sheet P is conveyed (which hereafter may be referred to simply as recording medium conveyance direction).

FIG. 12 is a sectional view of the image forming apparatus 1300 when a sheet P of recording medium is in each of the transfer nip T, the fixation nip N, and a nip between the pair of discharge rollers 104 at the same time. The spaces S1 and S2 in FIG. 12 are on the downstream side of the fixation nip N in terms of the recording medium conveyance direction. The moisture in the sheet P of recording medium turns into water vapor by being heated by the heater 105 in the fixation nip N, and fills the spaces S1 and S2. It sometimes occurs, when the image forming apparatus 1300 is in the above-described state, that air is blown into the adjacencies of the pressure roller 102 and the fixation film 103 by the air blowing apparatus 12.

FIG. 12 shows an air passage D1, through which air flows as air is blown into the image forming apparatus 1300 through the gap between the pair of discharge rollers 104, and a cover 107 for covering the fixation film 103. It also shows an air passage D2, through which air flows in the fixing device as air is blown into the fixing device through the opening 14, with which the conveyance guide 13 is provided, and then, through the gap between the pressure roller 102 and a cover 106. It is through these air passages D1 and D2 that the water vapor in the air in the spaces S1 and S2 is blown at the peripheral surface of the photosensitive drum 201. Thus, the water vapor adheres to the peripheral surface of the photosensitive drum 201, disturbing thereby the photosensitive drum 201 in surface potential, which in turn causes the image forming apparatus 1300 to reduce in quality with which a toner image is formed on the peripheral surface of the sheet P.

SUMMARY OF THE INVENTION

The present invention is for solving the above-described problems. Thus, the primary object of the present invention is to provide an image forming apparatus which can prevent the occurrence of the problem that the water vapor from recording medium condenses on the photosensitive member of the apparatus.

According to an aspect of the present invention, there is provided an image forming apparatus comprising a photosensitive member; an image forming portion configured to form an image on said photosensitive member; a fixing portion configured to fix an image on a recording material carrying the image transferred from said photosensitive member, while heating the recording material in a fixing nip, wherein said fixing portion is provided at a level higher than said image bearing member; said fixing portion including a first rotatable member contactable to the image on the recording material before the image is fixed on the recording material, a second rotatable member configured to cooperate with said first rotatable member to form the fixing nip, a first covering member configured to protect said first rotatable member, and a second covering member configured to protect said second rotatable member; and at least one opening for fluid communication between an inside and an outside of said fixing portion, said at least one opening being provided in said first covering member at a position lower than a line connecting a rotation axis of said first rotatable member and a rotation axis of said second rotatable member, as seen along a rotational axis of said second rotatable member.

Further features of the present invention will become apparent from the following description of exemplary embodiments with reference to the attached drawings.

Figure 2:
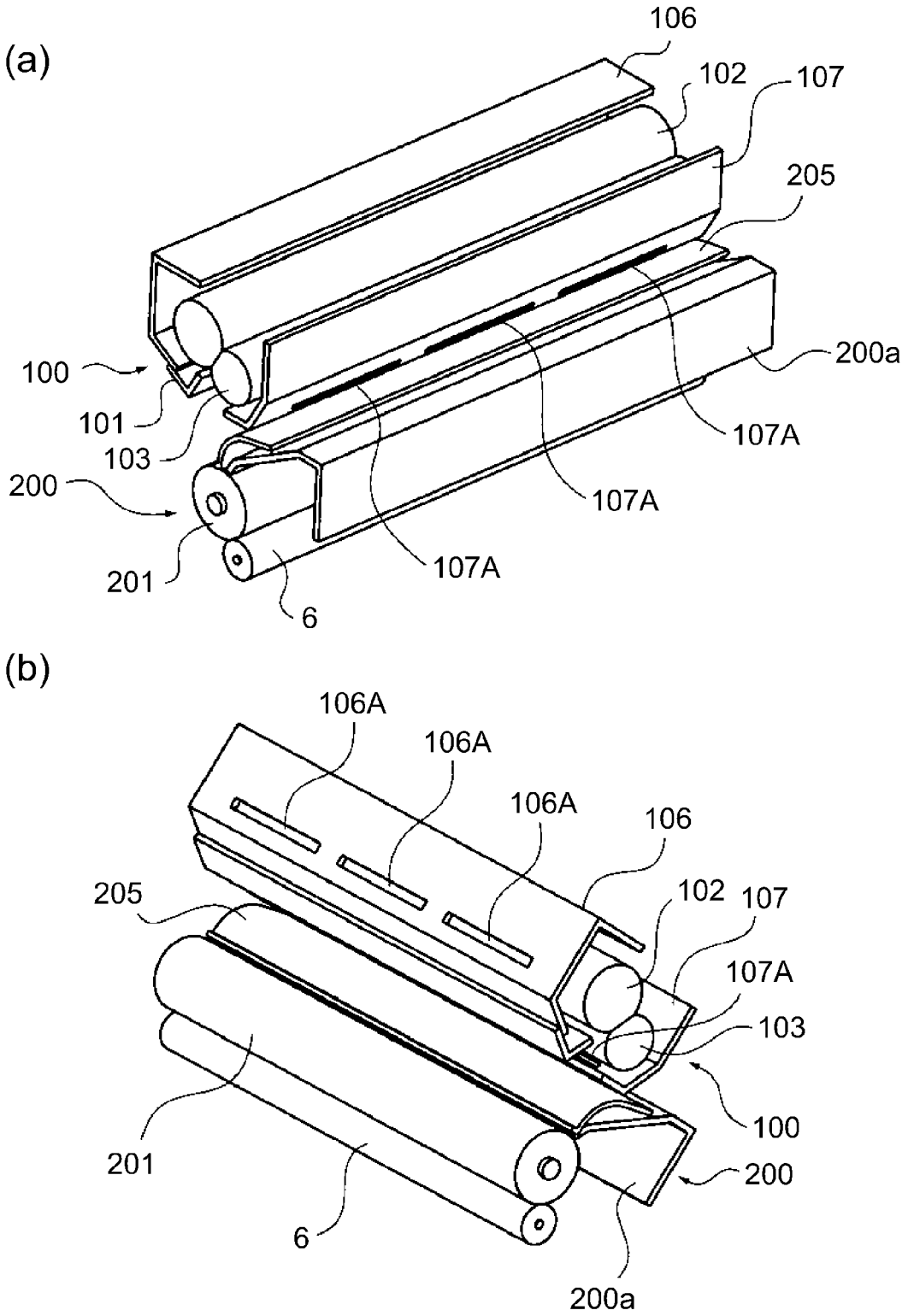

Parts (a) and (b) of FIG. 2 are perspective views of a combination of the fixing portion and process cartridge of the image forming apparatus in the first embodiment.

Figure 3:
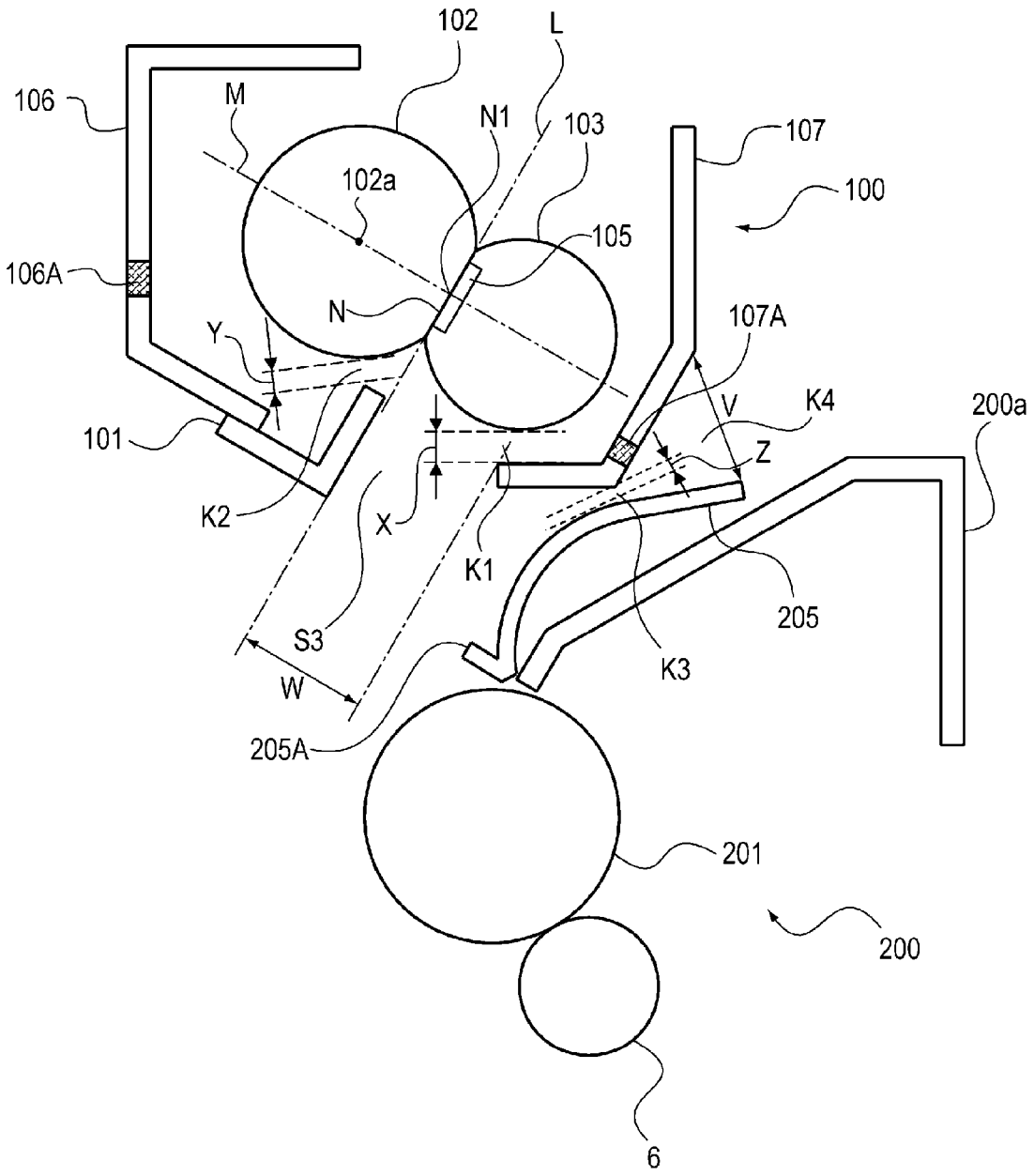

FIG. 3 is a sectional view of a combination of the fixing portion and process cartridge of the image forming apparatus in the first embodiment.

Figure 4:
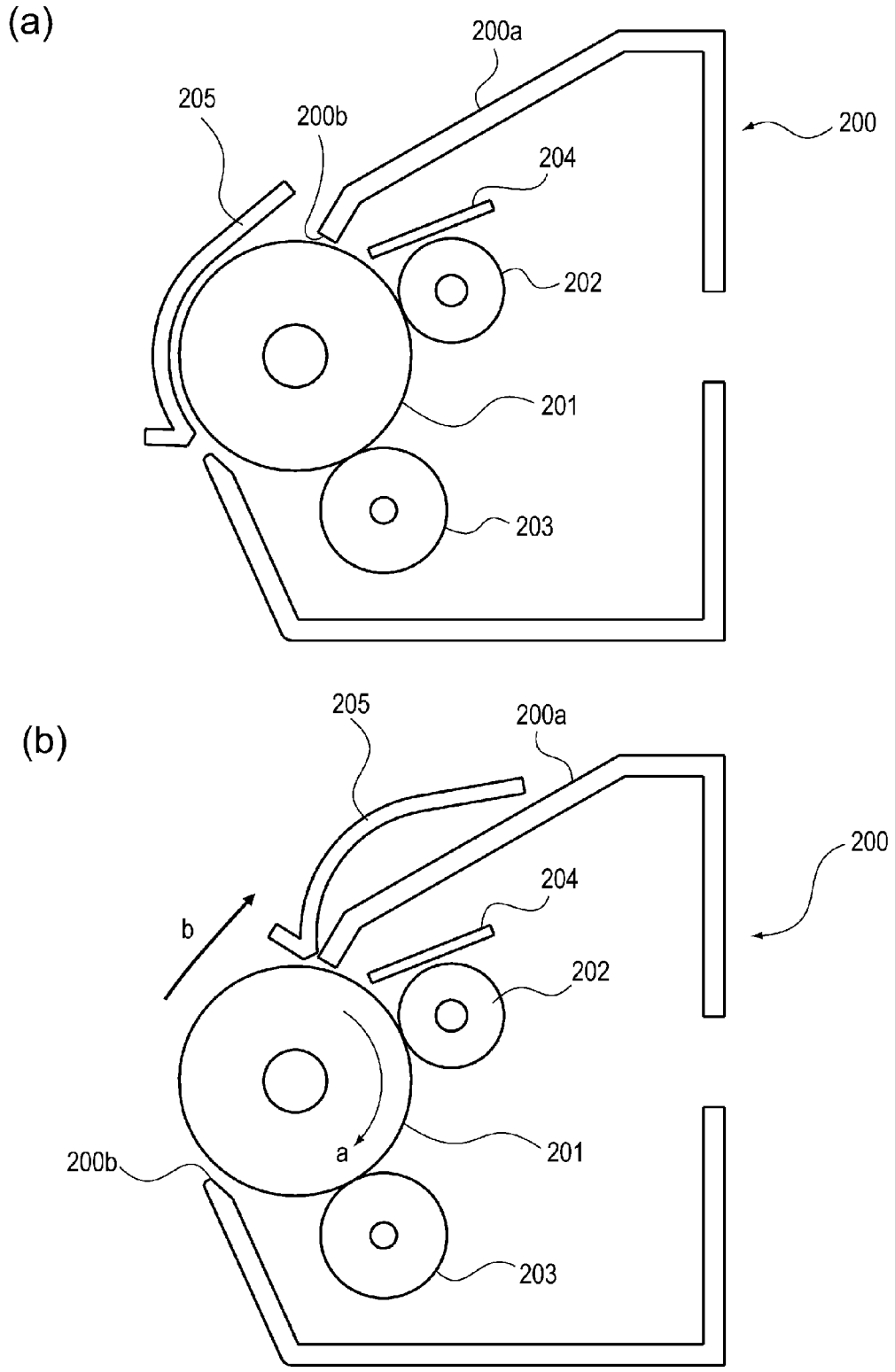

Parts (a) and (b) of FIG. 4 are sectional views of the process cartridge in the first embodiment, and show the structure of the cartridge.

Figure 5:
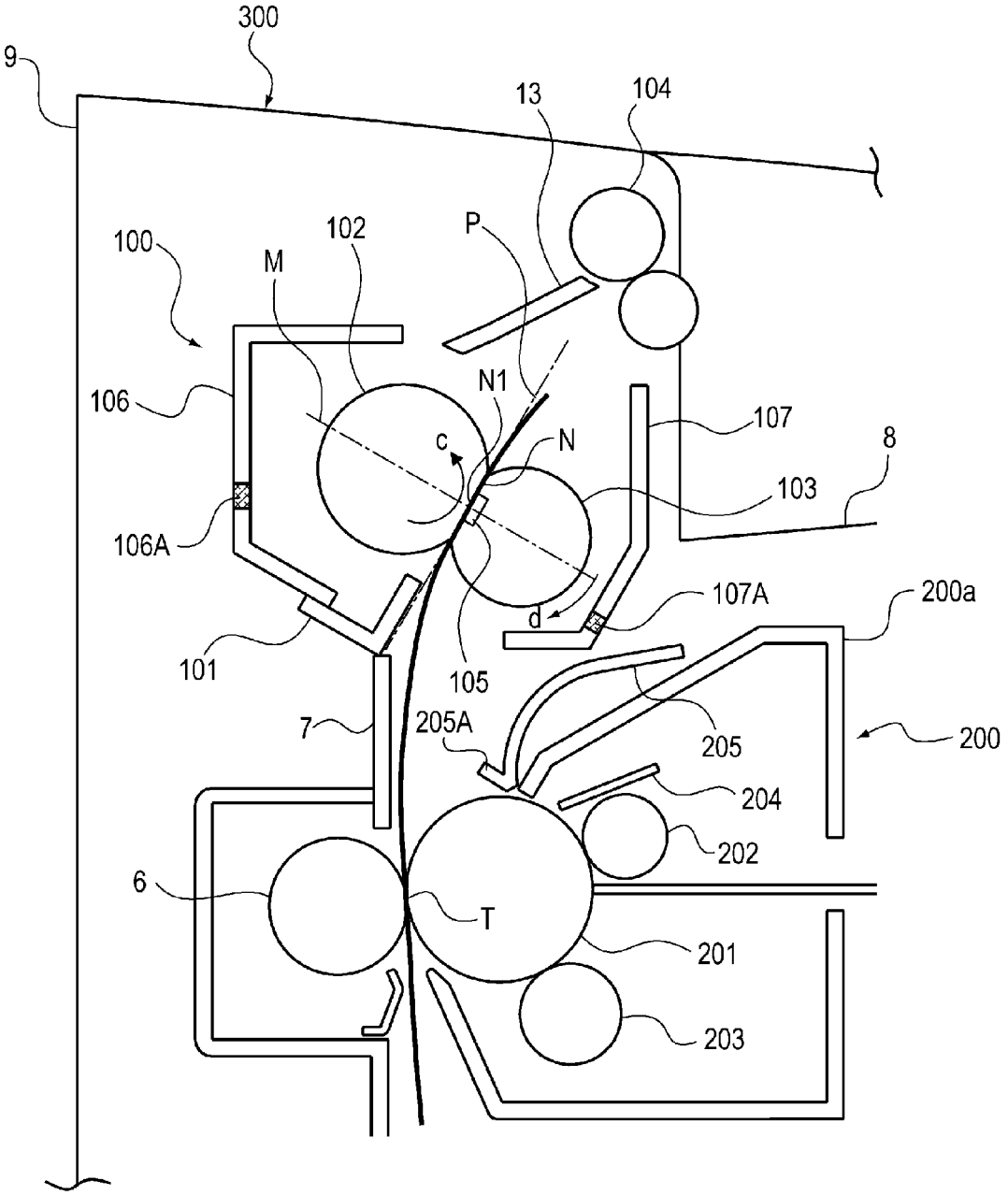

FIG. 5 is a sectional view of the image forming apparatus when a sheet of recording medium is in both the transfer nip and fixation nip at the same time.

Figure 6:
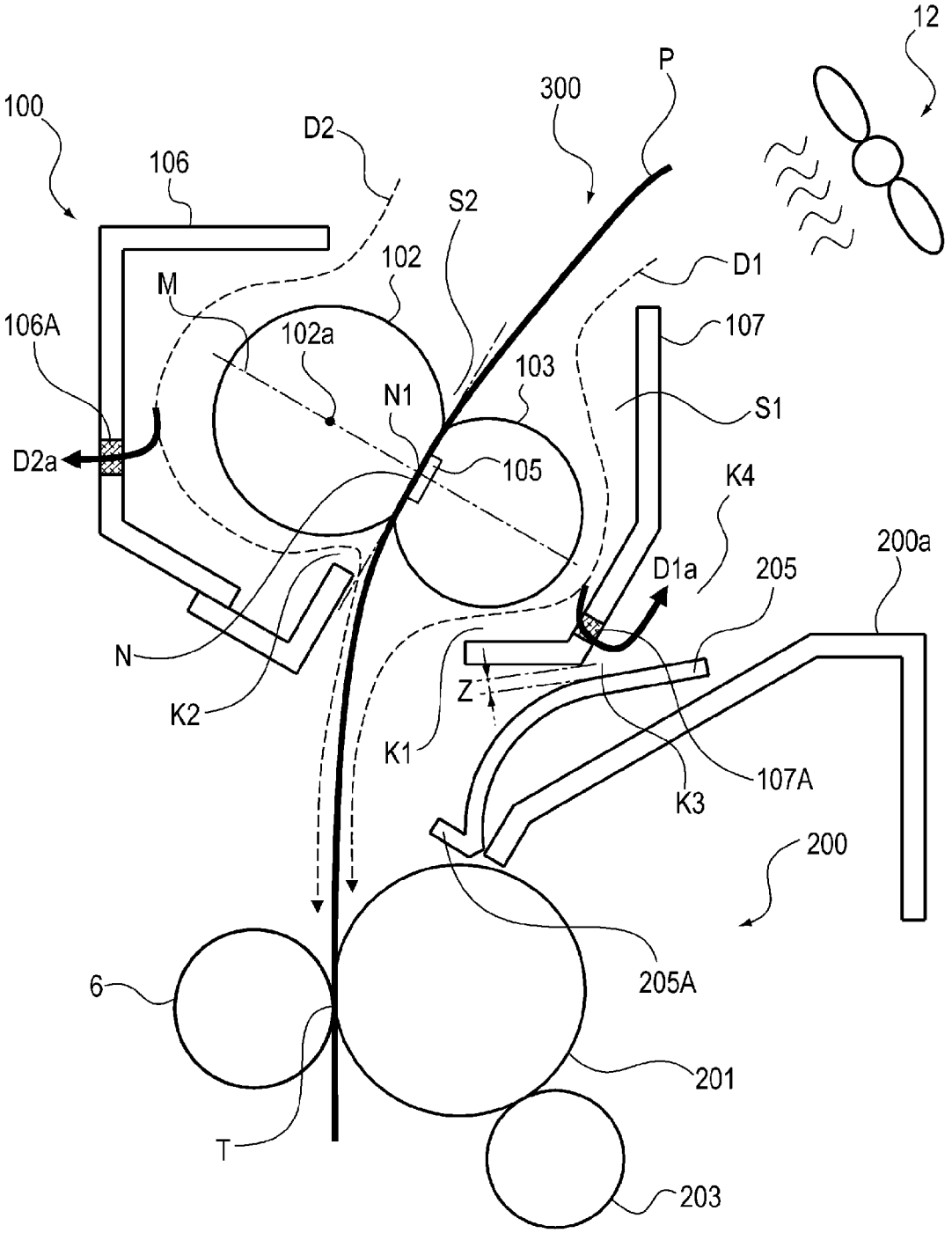

FIG. 6 is a schematic sectional drawing of the image forming apparatus in the first embodiment, which is for showing how the airflow toward the image bearing member is reduced in volume in the first embodiment.

Figure 7:
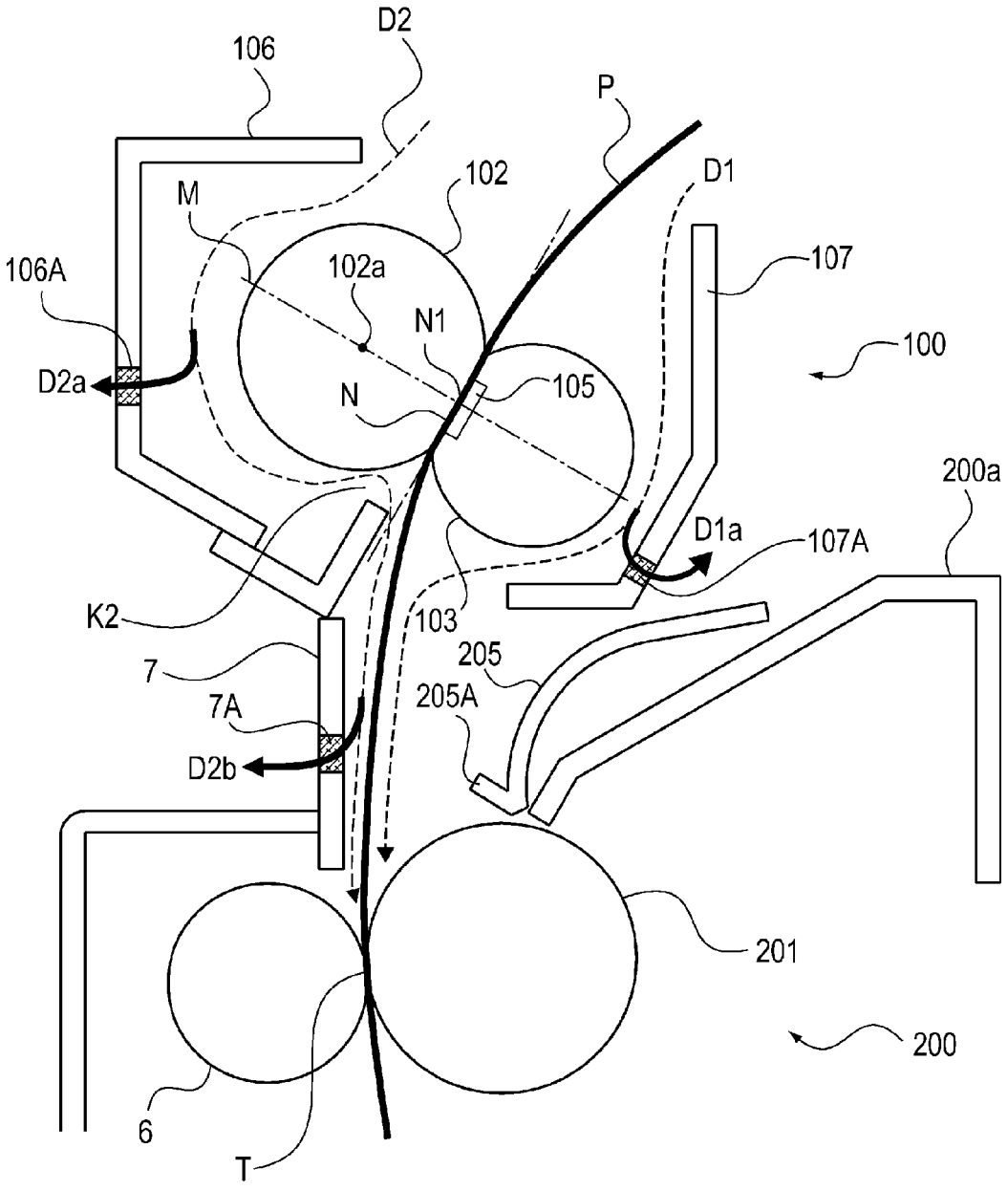

FIG. 7 is a schematic drawing for showing the airflow in the image forming apparatus in the second embodiment.

Figure 8:
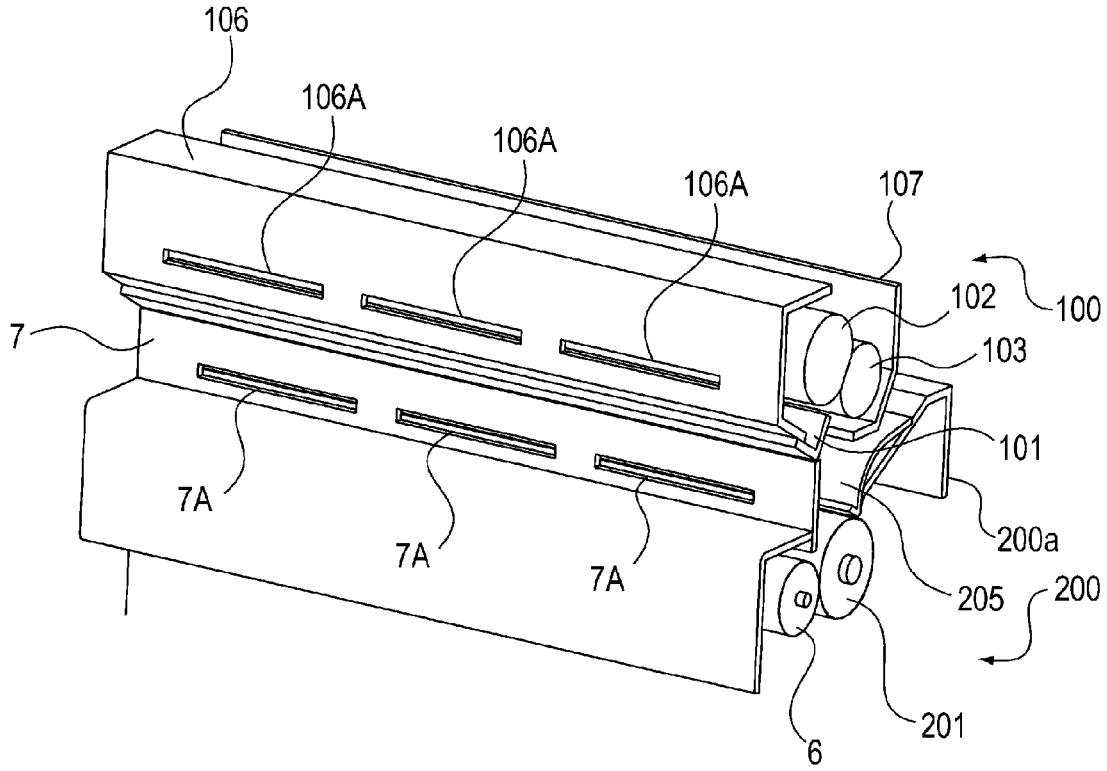

FIG. 8 is a perspective view of a combination of the fixing portion and process cartridge of the image forming apparatus in the second embodiment, and shows the structure of the combination.

Figure 9:
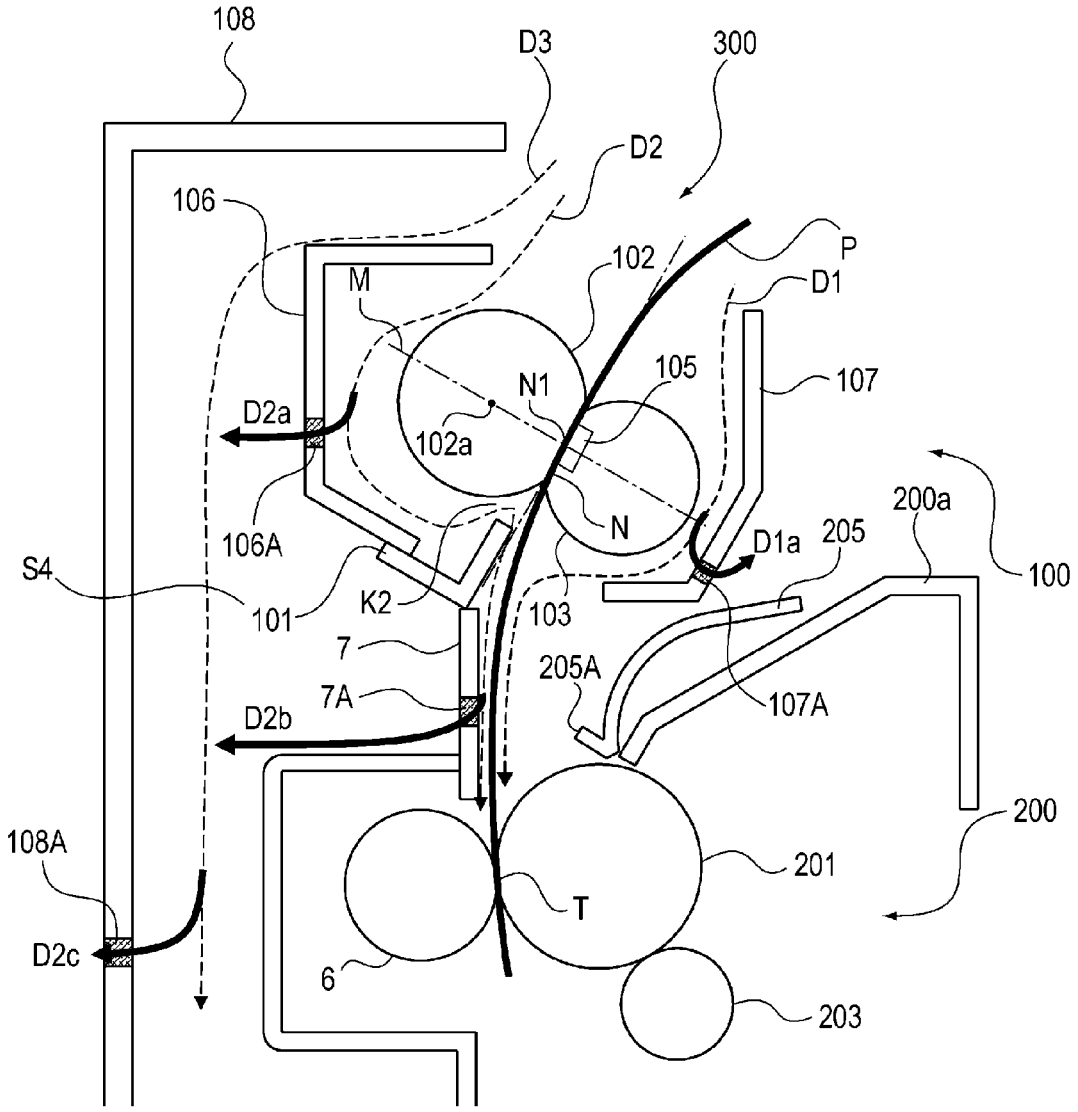

FIG. 9 is a schematic drawing for showing the airflow in the image forming apparatus in the third embodiment.

Figure 10:
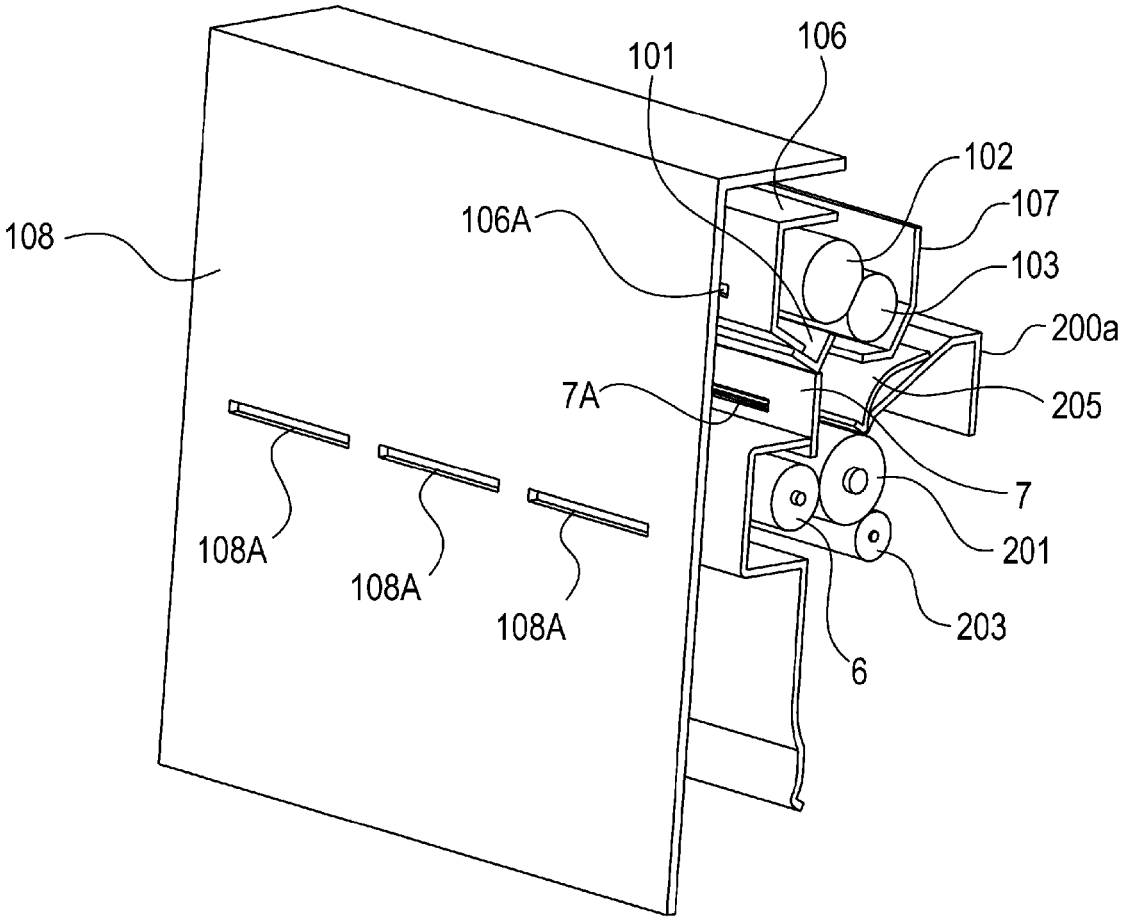

FIG. 10 is a perspective view of a combination of the fixing portion, process cartridge, and a part of the external shell, of the image forming apparatus in the third embodiment, and shows the structure of the part of the external shell.

Figure 11:
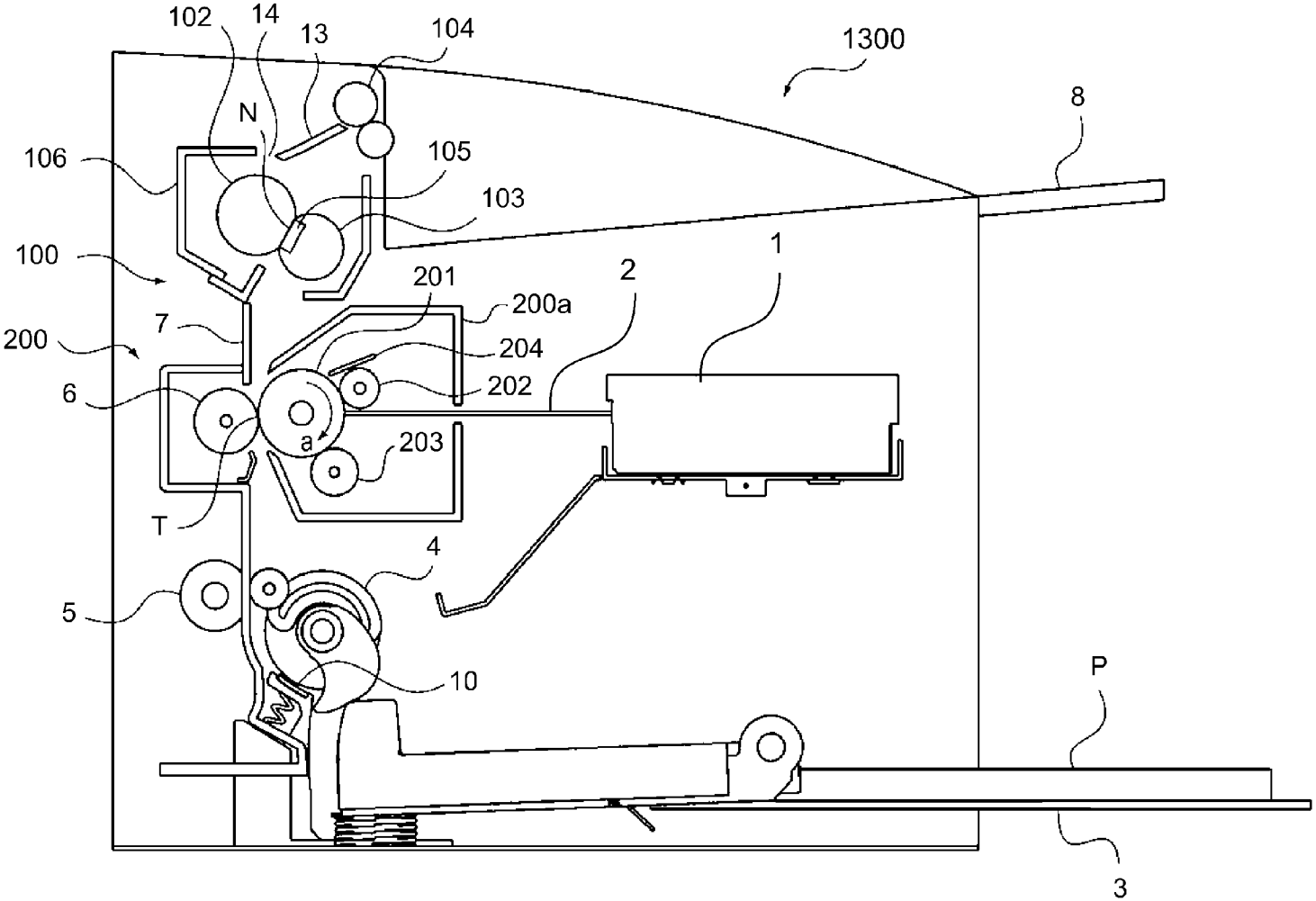

FIG. 11 is a sectional view of a comparative image forming apparatus.

Figure 12:
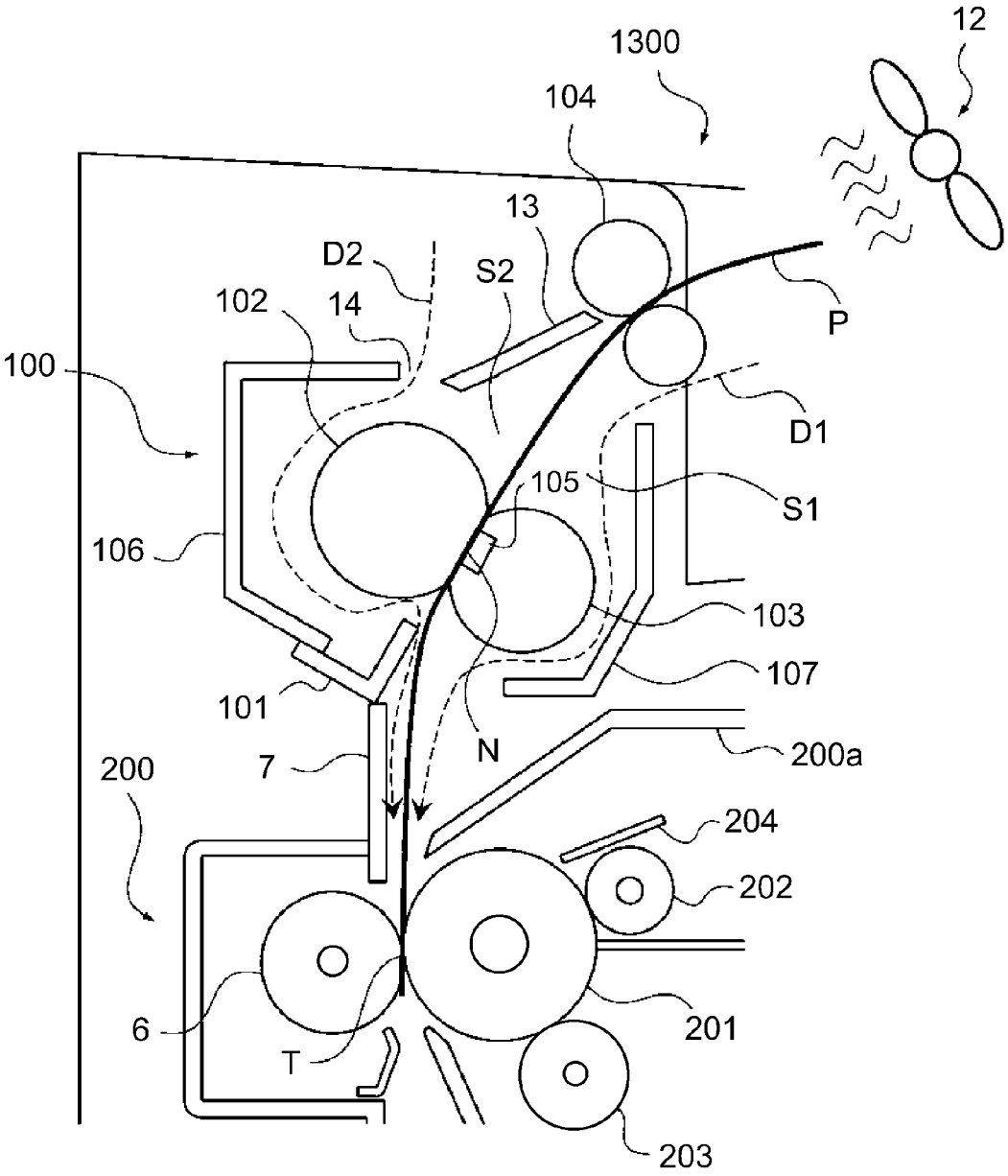

FIG. 12 is a schematic drawing for describing the cause of the formation of defective images by the comparative image forming apparatus.

DESCRIPTION OF THE EMBODIMENTS

Embodiment 1

To begin with, referring to FIGS. 1-6, the image forming apparatus in the first embodiment of the present invention is described.

<Image Forming Apparatus>

Figure 1:
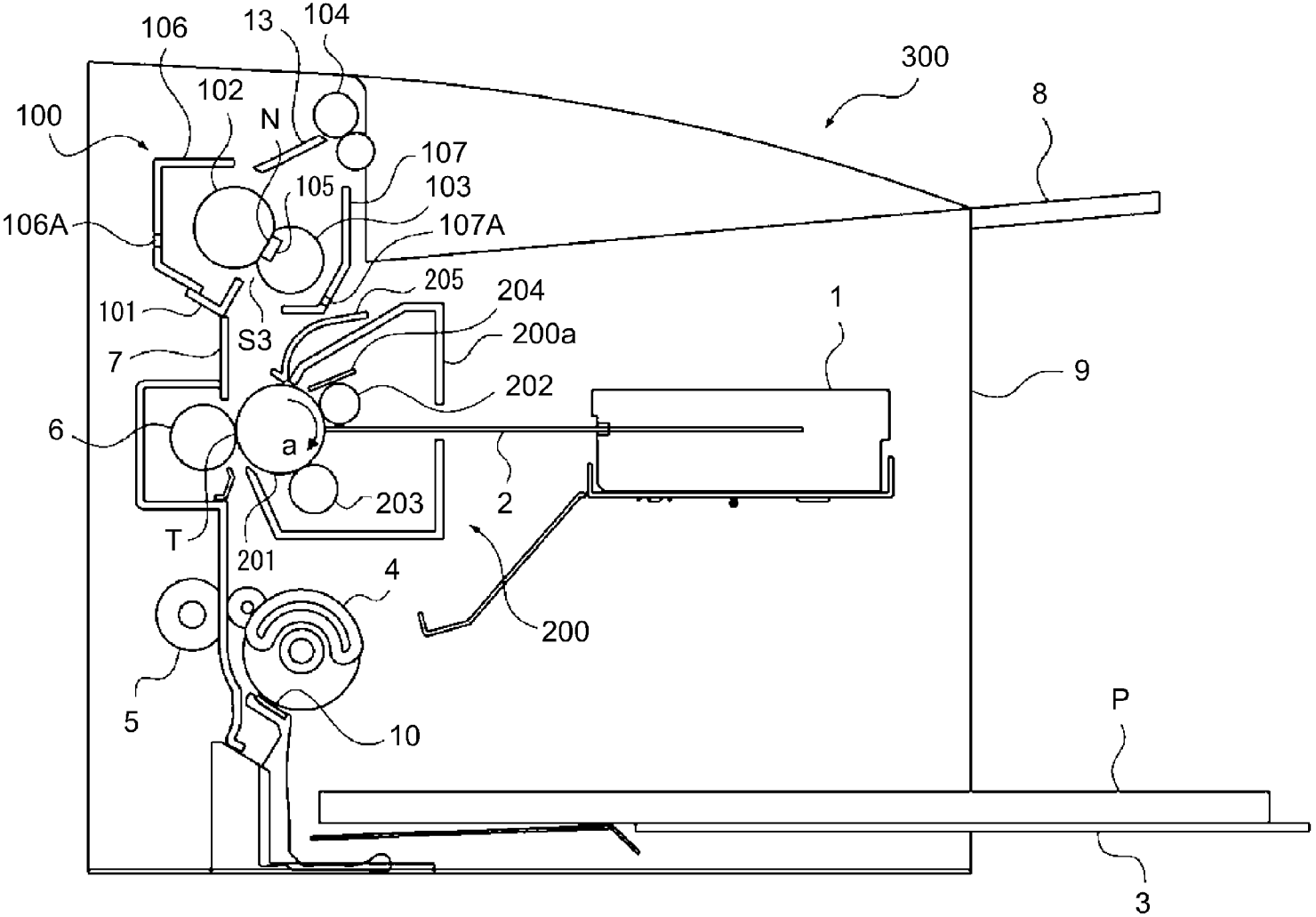
FIG. 1 is a sectional view of the image forming apparatus in the first embodiment of the present invention.

FIG. 1 is a sectional view of the image forming apparatus 300 in this embodiment. In a case where a given portion of the image forming apparatus 300 is the same in structure as, or similar in structure to, the counterpart in the image forming apparatus 1300 shown in FIG. 12, its description may be abbreviated. The image forming apparatus 300 shown in FIG. 1 is an example of a laser beam printer which uses an electrophotographic image formation process. The process which the image forming apparatus 300 uses to form an image on a sheet P of recording medium is the same as that which the image forming apparatus 1300 uses. Therefore, the process is not described in detail.

The image forming apparatus 300 has a photosensitive drum having a peripheral surface on which an image is formed by an image forming portion having a charge roller 202, a development roller 203, and a cleaner 204. The image forming apparatus 300 also has a fixing portion 100 which heats a sheet P of recording medium in a fixation nip to fix the image to the sheet P, after the transfer of the image onto the sheet P. The peripheral surface of the photosensitive drum 201 is scanned by a beam of laser light emitted while being modulated according to the information of the image to be formed. As a result, an electrostatic latent image is formed on the peripheral surface of the photosensitive drum 201. Then, the electrostatic latent image is developed into a toner image by the development roller 203. This toner image is transferred onto the sheet P of recording medium in the transfer nip T formed by the photosensitive drum 201 and a transfer roller 6. The cleaner 204 cleans the photosensitive drum 201. After the transfer of the toner image onto the sheet P, the sheet P is conveyed along a guide 7 to the fixing portion 100, which has a cylindrical fixation film 103 (first rotational member), a heater 105 which is in contact with the inward surface of the fixation film 103, and a pressure roller 102 (second rotational member) which forms a fixation nip N with the heater 105 by being pressed against the heater 105 with the presence of the fixation film 103 between itself and the heater 105. The toner image on the sheet P is fixed to the sheet P by being heated and pressed in the nip N. After the fixation of the toner image to the sheet P, the sheet P is conveyed further along a guide 13, and then, is discharged onto a tray 8 by way of a pair of discharge rollers 104. By the way, in terms of the vertical direction, the fixing portion 100 is positioned higher than the photosensitive drum 201 (image bearing member).

Further, the image forming apparatus 300 is provided with a pre-guide 101, which is the first guiding member for guiding a sheet P of recording medium to the fixation nip N, and is on the downstream side of the conveyance guide 7 and on the upstream side of the fixation nip N, in terms of the recording medium conveyance direction. There is a space S3, which is a part of the recording medium conveyance passage. It is between the pre-guide 101, and the cover 107 for protecting the fixation film 103.

The main assembly of the image forming apparatus 300 is fitted with a replaceable process cartridge 200, which can be installed into, or uninstalled from, the main assembly along the unshown guiding rails. The process cartridge 200 is made up of the photosensitive drum 201, the charge roller 202, the development roller 203, and a frame 200*a* in which the preceding components are integrally disposed. The frame 200*a* of the process cartridge 200 is provided with a shutter 205, which can be opened or closed.

Referring to part (a) of FIG. 4, when the process cartridge 200 is out of the main assembly of the image forming apparatus 300, the shutter 205 keeps the opening 200*b* of the process cartridge 200 covered (first position) to prevent the photosensitive drum 201 from being exposed to the ambient light.

On the other hand, as the process cartridge 200 is installed into the main assembly of the image forming apparatus 300, the shutter 205 is moved in the direction indicated by an arrow mark b in part (b) of FIG. 4 so that the photosensitive drum 201 is exposed from the frame 200*a* through the opening 200*b* (second position). Further, referring to FIG. 3, as the process cartridge 200 is installed into the main assembly of the image forming apparatus 300, the shutter 205 is moved into the space between the cover 107 (first cover) and shutter 205.

The main assembly frame 9 of the image forming apparatus 300, as shown in FIG. 1, supports various portions and devices, such as the fixing portion 100 and a laser scanner. The main assembly frame 9 also serves as the guiding members for guiding the process cartridge 200 when the process cartridge 200 is installed or uninstalled. Next, referring to FIG. 5, a part of the main assembly frame 9 of the image forming apparatus 300 that is on the opposite side of a cover 106 (second cover) from the pressure roller 102, and is for protecting the pressure roller 102, will be described.

Referring to FIG. 5, the pressure roller 102 is rotatably supported by an unshown pair of bearings, with which the main assembly frame 9 is provided.

The pressure roller 102 is rotationally driven in the direction indicated by an arrow mark c in FIG. 5 by the rotational driving force transmitted to the pressure roller 102 from an unshown driving force source. As the pressure roller 102 is rotated, the fixation film 103, which is remaining pressed upon the heater 105, is rotated in the direction indicated by an arrow mark d in FIG. 5, by the rotation of the pressure roller 102. A combination of the cover 106 (second cover) for protecting the peripheral surface of the pressure roller 102, and the cover 107 for protecting the outward surface of the fixation film 103, makes up the cover for the fixing portion 100, which prevents a user from coming into contact with the various structural components of the fixing portion 100, which tend to become very high in temperature. By the way, the heater 105 is controlled so that the temperature of the fixation nip N becomes and remains no less than 150° C. when an image is fixed.

<Countermeasure to Water Vapor>

Next, referring to parts (a) and (b) of FIG. 2 and to FIG. 3, a measure for dealing with the water vapor which emanates from a sheet P of recording medium as the sheet P is heated by the heater 105 is described. First, the positional relationship between an opening 107A (through hole; first opening) with which the cover 107 (first cover) of the fixing portion 100 is provided, and an opening 106A (through hole; second opening) with which the cover 106 (second cover) is provided, is described. The openings 107A and 106A bear the role of reducing the amount by which the air, which contains water vapor, flows toward the photosensitive drum 201.

Parts (a) and (b) of FIG. 2 are perspective views of the process cartridge 200. FIG. 3 is a sectional view of the combination of the fixing portion 100 and the process cartridge 200. By the way, in order to describe the positional relationship between the openings 106A and 107A in such a manner that it can be easily understood, FIGS. 2 and 3 do not show the conveyance guide 7, etc. Referring to FIGS. 2 and 3, in this embodiment, the cover 107 for protecting the peripheral surface of the photosensitive drum 201 is provided with the opening 107A as a means for dealing with the water vapor which emanates from a sheet P of recording medium as the sheet P is heated by the heater 105. Further, the cover 106 for protecting the peripheral surface of the pressure roller 102 is provided with the opening 106A.

Referring to FIG. 3, a referential letter X stands for the gap between the cover 107 and the fixation film 103, in the first space K1 provided on the upstream side of the fixation nip N in terms of the direction in which a sheet P of recording medium is conveyed. As the fixation film 103 is heated by the heater 105, its temperature becomes substantial. Thus, in order to prevent a user from coming into contact with the fixation film 103, the fixing portion 100 is structured so that the gap X is small. The gap X is narrower than the gap W in the space S3, which is a part of the passage for the sheet P. The gap X is roughly 2 mm-4 mm.

In terms of the direction parallel to the axis of the fixation film 103 (axis of pressure roller 102), the first space K1 is extended from one end of the area in which the fixation film 103 is present, to the other. The position of the opening 107A (through hole) with which the cover 107 is provided is as follows. Referring to FIG. 3, it is between the photosensitive drum 201 and a straight line M which coincides with the rotational axis 102*a* of the pressure roller 102 and is perpendicular to the line L which coincides with the fixation nip N. In other words, as the apparatus is seen from the direction parallel to the rotational axis of the second rotational member 102, the opening 107A, with which the first cover 107 is provided, is positioned lower than the line M which coincides with both the rotational axis of the first rotational member 103 and that of the second rotational member 102. Referring to part (a) of FIG. 2, the cover 107 is provided with three openings 107A. The cover 107 is made so that the sum in size of the three openings 107A (first opening) becomes no less than 100 $mm^2$ and no more than 300 $mm^2$.

Referring to FIG. 3, by the way, the fixing portion 100 is provided with the second space K2, which is between the peripheral surface of the pressure roller 102 and the above-described pre-guide 101, and which is on the upstream side of the fixation nip N in terms of the direction in which a sheet P of recording medium is conveyed. Further, the fixing portion 100 is structured so that the gap Y between the pressure roller 102 and the pre-guide 101, which is on the upstream side of the fixation nip N in terms of the recording medium conveyance direction, is rendered small enough to smoothly guide the leading edge of the sheet P into the fixation nip N. Further, the gap Y is narrower than the gap W. The gap Y is roughly 1.5 mm-5 mm.

In terms of the direction parallel to the axis of the pressure roller 102, the second space K2 extends across the entirety of the area in which the pressure roller 102 is present. The opening 106A (through hole) with which the cover 106 is provided is positioned in the area between the photosensitive drum 201 shown in FIG. 3, and the above-described straight line M. That is, as the apparatus is seen from the direction parallel to the rotational axis of the second rotational member 102, at least one of the second openings 106A, which connect the inside and the outside of the fixing portion 100, is positioned lower than the line M, which coincides with both the rotational center of the first rotational member 103 and that of the second rotational member 102.

Further, referring to part (b) of FIG. 2, the number of the second openings 106A with which the fixing portion 100 is provided is also three. The fixing portion 100 is constructed so that the sum in size of the three openings 106A (second openings) becomes no less than 100 $mm^2$ and no more than 300 $mm^2$.

Next, the positional relationship between the shutter 205 and opening 107A is described. Referring to FIG. 3, after the proper installation of the process cartridge 200 (unit) into the image forming portion in the image forming apparatus 300, the shutter 205 faces the opening 107A. The fixing portion 100 is provided with the third space K3, which is positioned lower than the opening 107A (first opening) and between the cover 107 and shutter 205 in terms of the vertical direction.

Further, the fixing portion 100 is also provided with the fourth space K4, which is on the opening 107A side of the third space K3 and between the cover 107 and shutter 205. The gap V of the fourth space K4 is wider than the gap Z in the third space K3. When the shutter 205 is in the position in which it opposes the opening 107A, the gap Z between the shutter 205 and the bottom edge of the slanted portion of the cover 107 is narrower than the gap V between the shutter 205 and the top edge of the slanted portion of the first cover 107, which has a greater distance from the photosensitive drum 201 than the opening 107A. Not only is the fourth space K4 in connection to the third space K3, but also, the fourth space K4 is shaped in the form of a letter V in cross section, so that the gap V widens along the bottom edge of the slanted portion of the cover 107 away from the opening 107A.

By the way, the fixing portion 100 is structured so that the gap Z in the third space K3 becomes no less than 0.5 mm and no more than 3.5 mm. In terms of the direction parallel to both the axial lines of the fixation film 103 and the photosensitive drum 201, one for one, the gap Z in the third space K3 between the cover 107 and shutter 205 extends across the entirety of the third space K3.

Next, referring to FIG. 6, the means (mechanism), in this embodiment, for dealing with the above-described water vapor is described. That is, the means (mechanism), in this embodiment, for minimizing the problem that, as a sheet P of recording medium is heated by the heater 105, water vapor emanates from the sheet P, condenses, in the form of a water droplet, on the peripheral surface of the photosensitive drum 201, and causes the image forming apparatus 300 to output defective images. FIG. 6 is a schematic sectional drawing of the portion of the fixing portion 100 that is related to the present invention. It is for describing the effectiveness of the means, in this embodiment, for dealing with the above-described water vapor. It shows the portion of the fixing portion 100 when a sheet P of recording medium is being pinched by both the fixation nip N and transfer nip T while being conveyed through the fixing portion 100.

Referring to FIG. 6, in a case in which the image forming apparatus 300 is used in the adjacencies of an air blowing apparatus 12 such as an air conditioner, it sometimes occurs that air is blown toward the fixation nip N of the fixing portion 100 from the air blowing apparatus 12. As air is blown toward the fixing portion 100 from the air blowing apparatus 12, the air flows through the air passages D1 and D2, and then, through the spaces S1 and S2 that are filled with the water vapor, which emanated from a sheet P of recording medium as the sheet P was heated by the heater 105. Consequently, the air picks up the water vapor.

In this embodiment, the cover 106 for protecting the peripheral surface of the pressure roller 102 is provided with the openings 106A. In addition, the cover 107 for protecting the outward surface of the fixation film 103 is provided with the openings 107A. Further, the openings 106A and 107A are positioned so that the above-described positional relationship between the two openings (or sets of openings) 106A and 107A are satisfied. Therefore, as a body of air is moved toward the photosensitive drum 201 through the passages D1 and D2, it is divided into the passages D1*a* and D2*a*, which correspond to the openings 106A and 107A, respectively. Thus, the fixing portion 100 is reduced in the amount of the air which flows toward the photosensitive drum 201, and therefore, in the amount of the water vapor condensation on the peripheral surface of the photosensitive drum 201. That is, this embodiment can prevent the formation of the defective images, which is attributable to the condensation of the water vapor from the sheet P, on the peripheral surface of the photosensitive drum 201.

Further, as described above, the gap Z in the third space K3 is narrower than the gap V in the fourth space K4. Therefore, after a body of air passes through the passage D1, and then, through the opening 107A, it is more likely to move toward the space K4 than toward the space K3. Thus, this embodiment can reduce the amount of the air flow toward the photosensitive drum 201.

On the other hand, the cleaner 204, which may be a cleaning blade, and the development roller 203, which remain in contact with the peripheral surface of the photosensitive drum 201 while the photosensitive drum 201 rotates in the direction indicated by the arrow mark a in part (b) of FIG. 4, increase in temperature due to friction. However, the shutter 205 is not in contact with these components, and therefore, is unlikely to significantly increase in temperature.

Further, the shutter 205 is supported by the frame 200*a* of the process cartridge 200 in such a manner that it can be opened or closed. Therefore, the heat within the frame 200*a* of the process cartridge 200 is likely to transfer to the shutter 205. Therefore, the shutter 205 remains relatively low in temperature. Therefore, as a body of air, which contains water vapor is exhausted from the fixing portion 100 through the passage D1*a* shown in FIG. 6, the water vapor in the body of air is likely to condense on the surface of the shutter 205 as it hits the shutter 205.

The problematic phenomenon that the peripheral surface of the photosensitive drum 201 is surrounded by a body of air which contains water vapor can be prevented by making the water vapor in the body of air which is exhausted from the fixing portion 100 through the passage D1*a* to condense on the outward surface of the shutter 205. However, as the water vapor in the body of air condenses on the surface of the shutter 205, the resultant water droplets are likely to fall onto the peripheral surface of the photosensitive drum 201 due to their own weight. Therefore, it is desired that these water droplets are prevented from falling onto the peripheral surface of the photosensitive drum 201. In this embodiment, therefore, the shutter 205 is provided with a protective wall 205A, which is formed as an integral part of the shutter 205 and extends across the entirety of the photosensitive drum side edge of the shutter 205, in the direction parallel to the rotational axis of the photosensitive drum 201, as shown in FIG. 6.

By the way, instead of providing the shutter 205 with the protective wall 205A, the shutter 205 may be provided with a groove which extends from one end of the shutter 205 to the other in terms of the direction parallel to the rotational axis of the photosensitive drum 201, along the edge of the protective wall 205A, which is next to the photosensitive drum 201, so that the water droplets resulting from the condensation of the water vapor in the body of air in the adjacencies of the shutter 205 are made to fall into this groove by their own weight to be held in the groove. This structural arrangement can also prevent the water droplets resulting from the condensation of the water vapor on the surface of the shutter 205 from being made to fall onto the peripheral surface of the photosensitive drum 201 by their own weight. As for the number of the protective walls 205A or grooves, it may be two or more in terms of the left-right direction of FIG. 6. As is evident from the forgoing, the shutter 205 functions as a blocking member for blocking a body of air which contains water vapor.

Here, if the size of the opening 107A (first opening) of the cover 107 is no more than 100 $mm^2$ (sum in size of the three first openings 107A is no more in size than 100 $mm^2$), the body of air which enters into the space S1 cannot be fully exhausted through the opening 107A.

Further, if the sum in size of the three first openings 107A is no less than 300 $mm^2$, air is allowed to flow into the main assembly of the image forming apparatus 300 by a large amount through the openings 107A while being heated by the heater 105. Thus, it is possible that the process cartridge 200 will be increased in temperature, which in turn has ill effects upon the image formation process. This is why the cover 107 is desired to be formed so that the sum in size of its three first openings 107A becomes no less than 100 $mm^2$ and no more than 300 $mm^2$.

In this embodiment, the cover 107 is provided with three openings 107A. However, the number of the openings 107A may be one, two, four or more openings, as long the sum in size of the openings (opening) 107A is no less than 100 $mm^2$ and no more than 300 $mm^2$.

Further, if the sum in size of the openings 106A (second openings) with which the cover 106 for protecting the peripheral surface of the pressure roller 102 is provided is no more than 100 $mm^2$ (sum in size of the three second openings 106A is no more than 100 $mm^2$), the body of air which enters the fixing portion 100 through the passage D2 cannot be fully exhausted through the opening 106A. Further, if the sum in size of the three second openings 106A is no less than 300 $mm^2$, it is possible that the pressure roller 102 will fail to increase in temperature to a preset level, and therefore, it is possible that the unfixed toner image on a sheet P of recording medium will fail to be successfully fixed to the sheet P.

Therefore, it is desired that the cover 107 is formed so that the sum in size of the three second openings 106A is no less than 100 $mm^2$ and no less than 300 $mm^2$. By the way, regarding the number of the second openings 106A, the cover 107 may be provided with one, two, or four or more openings, as long as the sum in size of the openings (opening) 106A is no more than 300 $mm^2$.

Further, referring to FIG. 6, if the gap Z between the protective member 205 (shutter) and the cover 107, in the third space K3, is no more than 0.5 mm, it is possible that, as the process cartridge 200 is installed into, or uninstalled from, the main assembly of the image forming apparatus 300, the protective member 205, which is attached to the frame 200*a* of the process cartridge 200 so that it can be opened or closed, will collide with the cover 107 with which the main assembly of the image forming apparatus 300 is provided. Therefore, it is possible that the protective member 205, the cover 107, and the adjacent components will be damaged by the collision.

Further, referring to FIG. 6, if the gap Z in the third space K3 is no less than 3.5 mm, the gap Z is not effective to block the body of air which flows toward the peripheral surface of the photosensitive drum 201 through the passage D1*a* which includes the opening 107A. Therefore, the fixing portion 100 is desired to be structured so that the gap Z between the shutter 205 and the cover 107, in the third space K3, is no less than 0.5 mm and no more than 3.5 mm.

According to this embodiment, even if air is blown at the fixation nip N of the fixing portion 100 by the air blowing apparatus 12, it is possible to prevent the problem that the water vapor which emanates from a sheet P of recording medium as the sheet P is heated by the heater 105 condenses on the surface of the photosensitive drum 201. Therefore, this embodiment can prevent the image forming apparatus 300 from forming images which suffer from the defects attributable to the condensation of water vapor on the peripheral surface of the photosensitive drum 201.

Embodiment 2

Next, referring to FIGS. 7 and 8, the structure of the fixing portion 100 in the second embodiment of the present invention is described. The components of the fixing portion 100 in the second embodiment, the portions thereof, etc., which are the same in structure as the counterparts in the first embodiment are given the same referential codes as the counterparts in the first embodiment, and are not described. Further, even if a given component, a portion thereof, etc., of the fixing portion 100 in this embodiment is different in referential code from the counterpart in the first embodiment, it is not described as long as it is the same in structure as the counterpart in the first embodiment.

The apparatus in this embodiment is different from the apparatus in the first embodiment only in that the former is provided with a conveyance guide 7, as the second guiding member, which is disposed on the downstream side of the transfer nip T in terms of the direction in which a sheet P of recording medium is conveyed. The conveyance guide 7 is provided with an opening 7A (third opening), which is a through hole. The conveyance guide 7 is formed so that the size of the opening 7A (third opening) (sum in size of all openings if conveyance guide 7 is provided with two or more openings 7A) is no less than 600 $mm^2$ and no more than 900 $mm^2$.

Next, referring to FIG. 7, the means, in this embodiment, for dealing with water vapor is described. If air enters the fixing portion 100 through the passage D2 by an amount which is greater than a preset value, it is possible that the air may not be entirely exhausted through the second opening 106A. Therefore, it is reasonable to think that a portion of the air will flow through the second space K2, flow along the surface (which is facing pressure roller 102 and the transfer roller 6) of the sheet P of recording medium which is being conveyed through the fixing portion 100, and reach the transfer nip T. Therefore, it is possible that the water vapor in the air will condense on the peripheral surface of the photosensitive drum 201, which in turn causes the image forming apparatus 300 to output unsatisfactory images.

In this embodiment, therefore, the conveyance guide 7 having an opening 7A is provided in the adjacencies of the downstream end of the transfer nip T in terms of the direction in which a sheet P of recording medium is conveyed. Thus, the air which contains water vapor is exhausted from the recording medium passage through the passage D2*b* which includes the opening 7A. Therefore, the water vapor in this portion of the air flow is prevented from condensing on the peripheral surface of the photosensitive drum 201. The third opening 7A connects the surface of the guiding member 7, which faces the recording medium passage, to the opposite surface of the guiding member 7.

Further, if the sum in size of the openings 7A (third openings) of the conveyance guide 7 is no more than 600 $mm^2$, it is impossible for the air which enters the fixing portion 100 through the passage D2, shown in FIG. 7, to be fully exhausted through the openings 7A with which the conveyance guide 7 is provided.

On the other hand, if the sum in size of these openings 7A is no less than 900 $mm^2$, it is possible that the sounds, which result from the friction between a sheet P of recording medium and any of the conveyance guides as the sheet P is conveyed, will leak out of the main assembly of the image forming apparatus 300. Therefore, it is desired that the sum in size of the openings 7A with which the conveyance guide 7 is provided is no less than 600 $mm^2$ and no more than 900 $mm^2$.

Referring to FIG. 8, the fixing portion 100 in this embodiment is an example of a fixing portion which is provided with three openings 7A, which are disposed with preset intervals in terms of the lengthwise direction (which is parallel to axial line of photosensitive drum 201 and that of the transfer roller 6). The conveyance guide 7 is formed so that the sum in size of the three openings 7A is no less than 600 $mm^2$ and no more than 900 $mm^2$. However, the conveyance guide 7 may be provided with one, two, four or more openings 7A, as long as the sum in size of the one or multiple openings 7A is no less than 600 $mm^2$ and no more than 900 $mm^2$. Otherwise, the fixing portion 100 in this embodiment is the same as the fixing portion 100 in the first embodiment. Further, it can provide the same effects as those provided the fixing portion 100 in the first embodiment.

Embodiment 3

Next, referring to FIGS. 9 and 10, the conveying device in accordance with the present invention and an image forming apparatus equipped with the conveying device in accordance with the present invention are described about their structure, with reference to those in the third embodiment. By the way, the components of the fixing portion 100 in this embodiment, the portions thereof, etc., which are the same in structure as the counterparts in the first embodiment are given the same referential codes as the counterparts in the preceding embodiments, and are not described. By the way, even if a given component, a portion thereof, etc., of the fixing portion 100 in this embodiment is different in referential code from the counterpart in the first embodiment, it is not described as long as it is the same in structure as the counterpart in the first embodiment.

Referring to FIG. 9, the fixing portion 100 in this embodiment is provided with an external cover 108, which is an external member for protecting the main assembly of the image forming apparatus 300. The external cover 108 is on the opposite side of the cover 106 from the pressure roller 102. Further, the external cover 108 is provided with an opening 108A (through hole; fourth opening) positioned so that the opening 108A is on the upstream side of the opening 7A (third opening) with which the conveyance guide 7 (second guiding member) is provided, in terms of the direction in which a sheet P of recording medium is conveyed. The fourth opening 108A is positioned lower than the second opening 106A. It connects the inward space of the apparatus 300 with the outward space of the apparatus 300.

Referring to FIG. 9, the image forming apparatus 300 is structured so that the opening 108A (fourth opening) with which the external cover 108 (external member) is provided is positioned not only on the upstream side of the opening 106A (second opening) with which the cover 106 (second cover) is provided, in terms of the recording medium conveyance direction, but also, is positioned lower (in terms of vertical direction of the image forming apparatus 300) than the opening 106A. In this embodiment, the size of the opening 108A (fourth opening) is no less than 150 $mm^2$ and no more than 500 $mm^2$. As described above, the opening 108A is positioned lower than the opening 106A and opening 7A.

Next, referring to FIG. 9, the measure, in this embodiment, for dealing with the above-described water vapor is described. The ambient air which contains water vapor enters the fixing portion 100 through the passage D2, shown in FIG. 9, and then, passes through the opening 106A of the cover 106, and the opening 7A of the conveyance guide 7 (passages D2*a* and D2*b*). Then, the air circularly moves in the space S4.

Therefore, it is possible that as the air circularly moves in the space S4, it will flow back into the recording medium passage through the opening 7A of the conveyance guide 7, or it will impede the airflow into the space S4 through the opening 7A by way of the passage D2*b*. Thus, it is reasonable to think that the air which contains water vapor will possibly reach the peripheral surface of the photosensitive drum 201, and the water vapor in the air will possibly condense on the peripheral surface of the photosensitive drum 201.

Referring to FIG. 9, in this embodiment, the fixing portion 100 is structured so that the opening 108A of the external cover 108 is positioned on the upstream side of both the openings 106A and 107A in terms of the direction in which a sheet P of recording medium is conveyed (closer to bottom of image forming apparatus 300). Thus, as the air which contains water vapor is exhausted into the space S4 by way of the passages D2*a* and D2*b*, not only does it flow downward in the main assembly of the image forming apparatus 300 by way of the passage D3, but it is also exhausted from the main assembly of the image forming apparatus 300 through the opening 108A of the external cover 108 (by way of a passage D2*c*).

Therefore, as the air exhausted into the space S4 by way of the passages D2*a* and D2*b*, it does not flow backward through the opening 7A while it circularly moves in the space S4, nor is the air which contains water vapor prevented from flowing into the space S4 by way of the passage D2*b*.

Further, if the sum in size of the openings 108A (fourth openings) with which the external cover 108 is provided is no more than 150 $mm^2$, it is impossible for the air in the space S4 to be fully exhausted through the openings 108A as the air is exhausted into the space S4 by way of the passages D2*a* and D2*b* shown in FIG. 9.

On the other hand, if the sum in size of the openings 108A (fourth openings) is no less than 500 $mm^2$, it is possible for the above-described frictional noise to leak out of the main assembly of the image forming apparatus 300. Thus, the sum in size of the openings 108A (fourth openings) is desired to be no less than 150 $mm^2$ and no more than 500 $mm^2$.

Referring to FIG. 10, the fixing portion 100 in this embodiment is an example of a fixing portion having the external cover 108 provided with three openings 108A, which are horizontally aligned (direction parallel to rotational axis of photosensitive drum 201 as well as that of the transfer roller 6). The size of each opening 108A is set so that the sum in size of the three openings 108A becomes no less than 150 $mm^2$ and no more than 500 $mm^2$. However, the number of the openings 108A may be one, two, four, or more, as long as the sum in size of the openings 108A is no less than 150 $mm^2$ and no more than 500 $mm^2$. Otherwise, the fixing portion 100 in this embodiment is the same in structure as the one in any of the preceding embodiments, and can provide the effects similar to those provided by those in the preceding embodiments.

<Miscellaneous>

In each of the preceding embodiments, the member for shielding the photosensitive drum 201 (image bearing member) from the fixation film 103 (heating means) was the shutter 205 attached to the process cartridge 200 so that it can be opened or closed relative to the process cartridge 200. However, the present invention is also applicable to an image forming apparatus, the shielding member of which is attached to its main frame instead of the process cartridge 200. Further, the preceding embodiments are not intended to limit the application of the present invention to an image forming apparatus, the fixing portion 100 of which is of the so-called film heating type which employs a fixation film (103) and a pressure roller (102). That is, the present invention is also applicable to an image forming apparatus, the fixing portion of which is of the so-called heat roller type which employs a fixation roller and a pressure roller.

Further, the preceding embodiments are not intended to limit the choice of the pressing member with which the fixing portion 100 is provided, to the pressure roller 102. That is, the present invention is also compatible with a fixing portion (100) which employs such a rotational member as a rotational belt in place of the pressure roller 102 in the preceding embodiment. Further, the heater 105 with which the fixing portion 100 is provided may be a heating member based on electromagnetic induction. Moreover, the fixation film 103 may be a multilayer fixation film having a heat generation layer in which heat can be generated by electromagnetic induction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-030800 filed on Feb. 22, 2016, which is hereby incorporated by reference herein in its entirety.

What is claimed is:

1. An image forming apparatus comprising:

(A) a photosensitive member;

(B) an image forming portion configured to form an image on said photosensitive member and to transfer the image from said photosensitive member onto a recording material;

(C) a fixing portion configured to fix the image on the recording material carrying the image transferred from said photosensitive member, while heating the recording material in a fixing nip, said fixing portion being provided at a position that is higher than a position of said photosensitive member in a vertical direction, said fixing portion including:

(a) a first rotatable member contactable to the image on the recording material before the image is fixed on the recording material;

(b) a second rotatable member configured to cooperate with said first rotatable member to form the fixing nip;

(c) a first covering member configured to protect said first rotatable member;

(d) a second covering member configured to protect said second rotatable member; and (e) at least one first opening for fluid communication between an inside and an outside of said fixing portion, said at least one first opening being provided in said first covering member at a position that is lower than a line connecting a rotational axis of said first rotatable member and a rotational axis of said second rotatable member, as seen along the rotational axis of said second rotatable member.

2. The image forming apparatus according to claim 1, wherein said fixing portion further includes (f) at least one second opening for fluid communication between the inside and the outside of said fixing portion, said at least one second opening being provided in said second covering member at a position that is lower than the line connecting the rotational axis of said first rotatable member and the rotational axis of said second rotatable member.

3. The image forming apparatus according to claim 1, wherein a total area of said at least one first opening is not less than 100 $mm^2$ and not more than 300 $mm^2$.

4. The image forming apparatus according to claim 2, wherein a total area of said at least one second opening is not less than 100 $mm^2$ and not more than 300 $mm^2$.

5. The image forming apparatus according to claim 1, wherein said photosensitive member and at least a part of said image forming portion are unitized into a unit that is detachably mountable to said image forming apparatus, wherein said unit is provided with a shutter member movable between a first position for protecting said photosensitive member and a second position for exposing said photosensitive member, wherein, when said unit is mounted to said image forming apparatus, said shutter member is moved to the second position, and wherein said shutter member faces said at least one first opening in a state in which said unit is mounted to said image forming apparatus.

6. The image forming apparatus according to claim 5, wherein said first covering member includes a first portion that is closer to said photosensitive member than said at least one first opening, and a second portion that is more remote to said photosensitive member than said at least one first opening, and wherein, in a state in which said shutter member faces said at least one first opening, a gap between said shutter member and said first portion of said first covering member is smaller than a gap between said shutter member and said second portion of said first covering member.

7. The image forming apparatus according to claim 5, further comprising a protective wall folded, relative to said shutter member, back in an upward direction at a photosensitive member side end portion of said shutter member in a state in which said shutter member faces said at least one first opening.

8. The image forming apparatus according to claim 2, further comprising (D) a guiding member provided between said photosensitive member and said fixing portion and configured to guide the recording material, said guiding member being provided with a guiding member opening for fluid communication between a recording material feeding path side surface of said guiding member and an opposite side of said guiding member.

9. The image forming apparatus according to claim 8, wherein a total area of said guiding member opening is not less than 600 $mm^2$ and not more than 900$mm^2$.

10. The image forming apparatus according to claim 2, further comprising:

(D) an outer casing member; and (E) at least one outer casing member opening for fluid communication between the inside and the outside of said image forming apparatus, said at least one outer casing member opening being provided in said outer casing member at a position that is lower than the position of said at least one second opening in the vertical direction.

11. The image forming apparatus according to claim 10, wherein a total area of said at least one outer casing member opening is not less than 150 $mm^2$ and not more than 500 $mm^2$.

12. The image forming apparatus according to claim 1, wherein the at least one first opening is elongated in a longitudinal direction of said fixing portion.

13. The image forming apparatus according to claim 12, wherein a plurality of such first openings is arranged in the longitudinal direction of said fixing portion.

14. The image forming apparatus according to claim 1, wherein said first rotatable member is a cylindrical film.

15. The image forming apparatus according to claim 14, wherein said fixing portion further includes (f) a heater contacting an inside surface of said cylindrical film.

16. The image forming apparatus according to claim 5, wherein said image forming portion includes a transfer roller configured to transfer the image from said photosensitive member onto the recording material, said transfer roller contacts said photosensitive member, and said second rotatable member is crossed by an extension of a contact portion between said photosensitive member and said transfer roller.

17. An image forming apparatus comprising:

(A) a photosensitive member;

(B) an image forming portion configured to form an image on said photosensitive member and to transfer the image from said photosensitive member onto a recording material;

(C) a fixing portion configured to fix the image on the recording material carrying the image transferred from said photosensitive member, while heating the recording material in a fixing nip, said fixing portion being provided at a position that is higher than a position of said photosensitive member in a vertical direction, said fixing portion including:

(a) a first rotatable member contactable to the image on the recording material before the image is fixed on the recording material;

(b) a second rotatable member configured to cooperate with said first rotatable member to form the fixing nip;

(c) a covering member configured to protect said first rotatable member and said second rotatable member; and (d) at least one opening for fluid communication between an inside and an outside of said fixing portion, said at least one opening being provided in said covering member, and said at least one opening is elongated in a longitudinal direction of said fixing portion.

18. The image forming apparatus according to claim 17, wherein a total area of said at least one opening is not less than 100 $mm^2$ and not more than 300 $mm^2$.

19. The image forming apparatus according to claim 17, wherein a plurality of such openings is arranged in the longitudinal direction of said fixing portion.

20. The image forming apparatus according to claim 17, wherein said image forming portion includes a transfer roller configured to transfer the image from said photosensitive member onto the recording material, said transfer roller contacts said photosensitive member, and said second rotatable member is crossed by an extension of a contact portion between said photosensitive member and said transfer roller.

21. The image forming apparatus according to claim 17, wherein said first rotatable member is a cylindrical film.

22. The image forming apparatus according to claim 21, wherein said fixing portion further includes a heater contacting an inside surface of said cylindrical film.

* * * * *